United States Patent [19]

Ford et al.

[11] Patent Number: 4,715,839

[45] Date of Patent: Dec. 29, 1987

[54] NOVELTY BELT

[75] Inventors: Allan L. Ford, Philadelphia; Jay H. Baronoff, Yardley, both of Pa.

[73] Assignee: Reborn Products Co., Inc., Bensalem, Pa.

[21] Appl. No.: 915,912

[22] Filed: Oct. 1, 1986

Related U.S. Application Data

[63] Continuation of Ser. No. 757,593, Jul. 22, 1985, abandoned.

[51] Int. Cl.[4] ..... A63H 33/00

[52] U.S. Cl. ..... 446/28; 2/300; 2/322; 2/338; 24/163 K

[58] Field of Search ..... 446/28, 26, 901; 24/163 K, 303; 224/163; 2/322, 300, 321

[56] References Cited

U.S. PATENT DOCUMENTS

| | | | |
|---|---|---|---|
| 3,026,642 | 3/1962 | Ryan | 446/28 X |
| 3,063,118 | 11/1962 | Salter et al. | 24/303 |
| 3,616,571 | 11/1971 | Adickes | 446/28 |
| 4,313,230 | 2/1982 | Chovaniec | 24/163 K X |
| 4,389,775 | 6/1983 | Collins | 24/163 K X |
| 4,425,735 | 1/1984 | Kulesza et al. | 446/28 |

*Primary Examiner*—Mickey Yu

*Attorney, Agent, or Firm*—Caesar, Rivise, Bernstein, Cohen & Pokotilow, Ltd.

[57] ABSTRACT

A novelty item comprising a combination belt and toy. The belt comprises a band, such as formed of an elastic material and having a pair of ends. The belt includes a buckle having a first member secured to one end of the band and a second member secured to the other end of the band. One of the members includes a magnet for releasable securement to the other of the members. One of the members also includes an outer surface to which one component of a Velcro® fastening system is fixedly secured. A toy, such as a wheeled motor vehicle, having the second component of the Velcro® fastening system fixedly secured thereto is arranged to be releasably secured onto the buckle so as to form decorative ornamentation for the buckle when it is in place. The toy can be removed by disconnecting the two Velcro® components so that the toy can function as a conventional amusement or toy device.

8 Claims, 3 Drawing Figures

FIG. 1
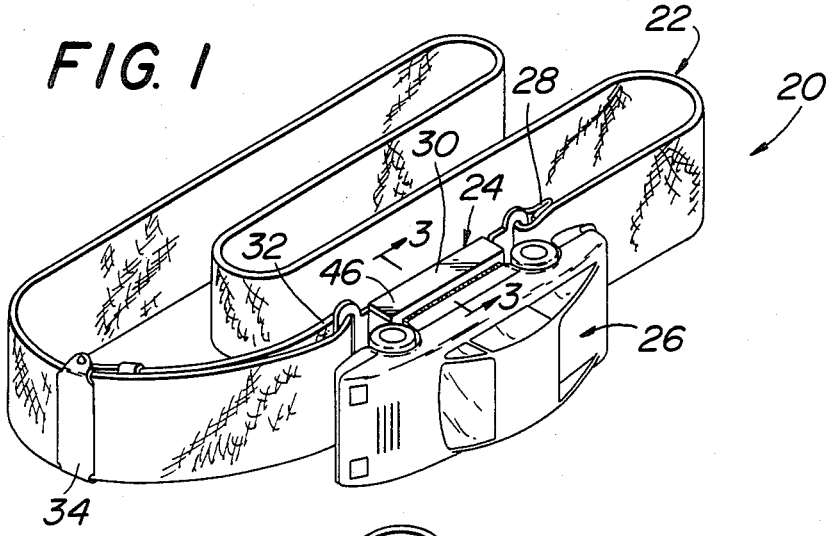
FIG. 2
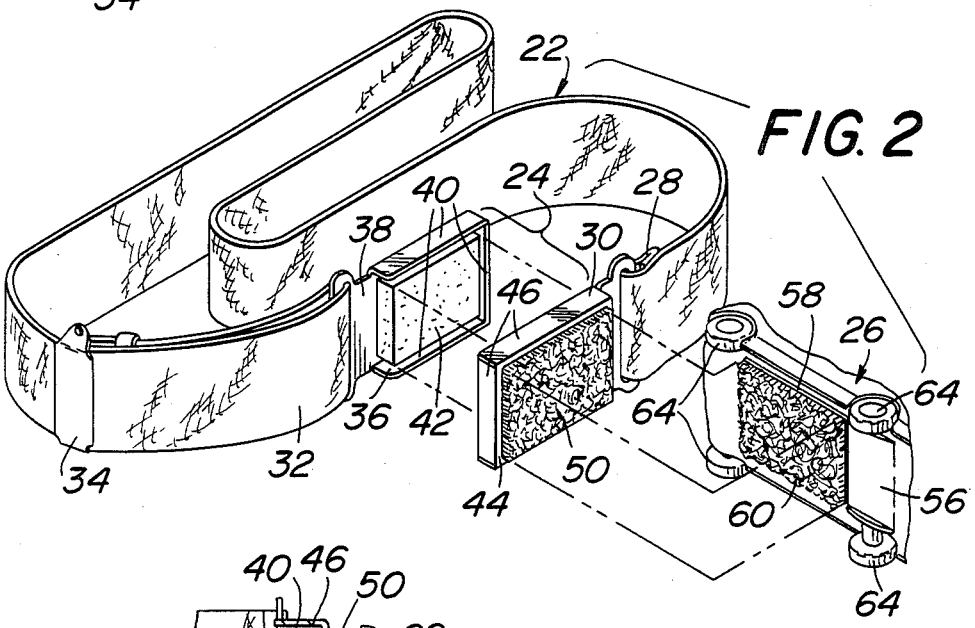
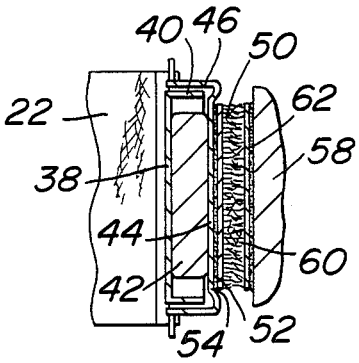
FIG. 3

NOVELTY BELT

This application is a continuation of application Ser. No. 757,593, filed July 22, 1985, now abandoned.

BACKGROUND OF THE INVENTION

This invention relates generally to articles of apparel and more particularly to novelty belts in the form of a combination belt and toy.

Many commericially available belts include buckles which are both decorative and detachable so as to be arranged to be releasaeably secured to the belt to change the belt's appearance. Children's belts frequently include decorative buckles which are fanciful in design, e.g., contain cartoon characters, likenesses of persons, animals, toys, vehicles, etc. thereon.

While such belts are certainly suitable for their intended function, namely, the support of clothing and in addition may provide aesthetic appeal to children, they offer very little in the way of play value to the child.

OBJECTS OF THE INVENTION

Accordingly, it is the general object of the instant invention to provide wearing apparel in the form of a novelty item of a combination belt and toy which overcomes the disadvantages of the prior art.

It is a further object of the instant invention to provide a novelty item in the form of a belt having a buckle including a toy mounted thereon.

It is still a further object of this invention to provide a novelty item in the form of a belt having a buckle including a toy releasably secured thereto for ornamentation when secured to the buckle and to serve as a conventional toy when removed from the buckle.

It is still a further object of this invention to provide a novelty item in the form of a belt having a buckle on which a toy is releasable secured by contact holding fastening means to facilitate the securement and release of the toy with respect to the buckle.

SUMMARY OF THE INVENTION

These and other objects of the instant invention are achieved by providing a novelty item in the form of a combination belt and toy. The novelty item comprises a band of material having a pair of ends and adapted to encircle the waist and buckle means secured to the band. The buckle means includes a first member secured to one end of the band and a second member secured to the other end of the band. The members are arranged to be releasably secured to each other. One of the members includes an outer surface. A toy is provided having means for releasably securing it onto the outer surface of said one member. When the toy is secured to the outer surface of the one member it forms decorative ornamentation for the buckle, whereas when the toy is removed it is usable as a conventional toy.

DESCRIPTION OF THE DRAWING

Other objects and many of the attendant advantages of this invention will be readily appreciated as the same becomes better understood by reference to the following detailed description when considered in connection with the accompanying drawing wherein:

FIG. 1 is a perspective view of the novelty item of the subject invention showing one type of toy utilized therein;

FIG. 2 is a exploded perspective view of the components shown in FIG. 1; and FIG. 3 is an enlarged sectional view taken along line 3—3 of FIG. 1.

DETAILED DESCRIPTION OF THE PREFERRED EMBODIMENT

Referring now in greater detail to the various figures of the drawing wherein like reference characters refer to like parts, there is shown at 20 in FIG. 1 a novelty item of apparel constructed in accordance with this invention. As can be seen that novelty item basically comprises a belt 22 having a buckle 24 upon which is releasably secured a toy device 26. In the embodiment shown herein the toy device 26 is a model automobile. Other wheeled toy vehicles can also be used in this invention. In fact, in accordance with the subject invention, any type of toy suitable for securement to the buckle 24 can be used and hence this invention in not limited to the use of cars or other wheeled vehicles.

The belt 22 is of conventional construction and comprises a web of elasticized fabric, leather, plastic, etc. The belt 22 includes a first end 28 to which one portion of a conventional type buckle 30 is fixedly secured. The other end of the belt 22 is in the form of a loop 32 whose size can be adjusted by a clasp device 34 in a conventional manner to adjust the size of the belt. Mounted on the loop 32 is the second, and mating portion 36 of the buckle 24.

As mentioned earlier the buckle 24 is of conventional construction and in the embodiment shown herein is a magnetic closure. To that end the portion 36 is shaped like a tray having a planar base portion 38 and three peripheral sidewalls 40. A bar magnet 42 is fixedly mounted on the base 38 of the tray and located within the confines of the sidewalls 40. As can be seen in FIGS. 2 and 3 the other portion 30 of the buckle 24 is a generally planar member having a rectangular base 44 and four peripheral sidewalls 46 extending about the base's periphery. The sidewalls about the base of buckle portion 30 form a cavity for receipt of the buckle portion 36. The buckle portion 30 is formed of a ferro-magnetic material so that when buckle portion 36 is inserted within buckle portion 30 the two buckle portions are held together by magnetic engagement.

Referring now to FIGS. 2 and 3 the details of the means for releasably securing the toy 26 to the buckle will now be described. To that end and in accordance with the preferred embodiment of this invention the releaseable securement means comprises a Velcro® fastening system such as sold by the Velcro Company. As is known the Velcro® fastening system comprises a pair of components, one component of which is a web of fabric having a large plurality of hook-like elements thereon and the other component is a web of fabric having a large plurality of loop-like elements thereon. When the hook-like elements are brought into contact with the loop-like elements they engage one another and secure the two components together against accidental disconnection. However, the two components can be readily peeled apart and separated when desired. Thus, in accordance with this invention one component 50 of the Velcro® fastening system is fixedly secured, such as by an adhesive 52, in a slight recess or depression 54 formed in the outer surface of the base 44 of the buckle portion 30. In the embodiment shown herein the Velcro® portion 50 is the multi-loop component.

As can be seen in FIG. 2 the underside 56 of the chassis of the toy car 26 includes a generally planar wall portion 58 on which is fixedly secured the other component 60 of the Velcro ® fastening system. That component is held in place via an adhesive 62 (FIG. 3). In the embodiment shown herein the component 60 consists of the multi-hook component.

In the embodiment shown herein the toy car 26 includes plural wheels which are arranged to rotate and which are located outside the periphery of the buckle 30. Accordingly, the toy 26 can be releasably secured to the buckle by causing its Velcro ® portion 60 to engage the Velcro ® portion 50 on the buckle. When the car is so positioned, as shown in FIG. 1, it completely covers the buckle to provide it with ornamentation which is particularly attractive to children. Thus, when the car is mounted on the belt, the belt provides the full functionality of prior art belts insofar as garment support is concerned. Moreover, by virture of the toy mounted thereon, substantial aesthetic appeal is achieved.

When it desired to play with the toy 26 all that is required is to peel the toy off of the buckle thereby disengaging the two Velcro ® components. The toy can then be used in a conventional manner such as by rolling it on the ground and without interference by the projecting hooks of component 60 inasmuch as those hooks do not project to far below the bottom of the car to interfere with the rolling action.

Without further elaboration, the foregoing will so fully illustrate my invention that others may, by applying current or future knowledge, readily adopt the same for use under various conditions of service.

We claim:

1. A novelty item in the form of a combination belt and toy, said novelty item comprising a toy and band of material having a pair of ends and adapted to encircle the waist of a wearer to form said belt for supporting a garment thereon, buckle means secured to said band for releasably securing the ends of said band together, said buckle means including a first portion attached to one of said pair of ends of the band of material and a second portion for mating with said first portion attached to the other of said pair of ends of the band of material, said first portion overlying said second portion when said first and second portions are mated, said first portion having an outer surface and peripheral sidewalls, said toy including a lower surface and wheel means adjacent the periphery of said lower surface and extending below said lower surfae, said toy having means on its lower surface for releasably securing it onto said outer surface of said first portion against accidental disconnection therefrom, said toy completely covering the buckle means with the wheel means of said toy being outside the pheriphery of the sidewalls of said first portion of said buckle means when the toy is releasably secured to said buckle means, whereupon once the toy is so secured, it forms decorative ornamentation covering said buckle means, whereas said toy is removed from said surface, it can function as a toy or amusement device while leaving the belt still useful to support said garment.

2. The combination of claim 1 wherein said means for releasably securing said toy to said outer surface comprises a two-component fastening system, with one of said two components being fixedly secured to said outer surface of said first portion and with the other of said components being fixedly secured to the lower surface of said toy.

3. The combination of claim 2 wherein said two-component fastening system comprises a first component having a plurality of hook-like members and a second comonent having a plurality of loop-like members, said two components arranged to be releasably secured to each other upon contact of said hook-like elements with said loop-like elements.

4. The combination of claim 1 wherein said wheeled toy comprises a model motor vehicle.

5. The combination claim 1 wherein one of said two portions of said buckle means includes magnetic means for magnetic engagement with said other portion of said buckle means.

6. The combination of claim 5 wherein said means for releasably securing said toy to said outer surface comprises a two-component fastening system, with one of said two components being fixedly secured to said outer surface of said first portion and with the other of said components being fixedly secured to the lower surface of said toy.

7. The combination of claim 6 wherein said two-component fastening system comprises a first component having a plurality of hook-like members and a second component having a plurality of loop-like members, said two components arranged to be releasably secured to each other upon contact of said hook-like elements with said loop-like elements.

8. The novelty item of claim 1 wherein said wheel means are rotatable.

* * * * *